United States Patent [19]

Herbst

[11] Patent Number: 4,664,555

[45] Date of Patent: May 12, 1987

[54] TENSION MEMBER FOR A ROCK ANCHOR OR THE LIKE

[75] Inventor: Thomas Herbst, Wessling, Fed. Rep. of Germany

[73] Assignee: Dyckerhoff & Widmann Aktiengesellschaft, Munich, Fed. Rep. of Germany

[21] Appl. No.: 835,533

[22] Filed: Mar. 3, 1986

[30] Foreign Application Priority Data

Mar. 5, 1985 [DE] Fed. Rep. of Germany ..... 3507732

[51] Int. Cl.[4] ..... E21D 20/02

[52] U.S. Cl. ..... 405/260; 405/259

[58] Field of Search ..... 405/239, 260, 259, 262; 138/172, 174, 176, 173

[56] References Cited

U.S. PATENT DOCUMENTS

| | | | |
|---|---|---|---|
| 3,234,969 | 2/1966 | DuMont | 138/173 X |
| 3,477,474 | 11/1969 | Mesler | 138/174 X |
| 3,653,217 | 4/1972 | Williams | 405/260 |
| 3,842,608 | 10/1974 | Turzillo | 405/239 X |
| 3,901,039 | 8/1975 | Lundkvist | 405/260 |
| 4,196,755 | 4/1980 | Kutnyak et al. | 138/174 X |
| 4,279,340 | 7/1981 | Lang | 405/261 X |
| 4,302,131 | 11/1981 | Brown | 405/260 |
| 4,410,476 | 10/1983 | Redding et al. | 138/174 X |
| 4,564,315 | 1/1986 | Rozanc | 405/260 X |

*Primary Examiner*—Dennis L. Taylor

*Attorney, Agent, or Firm*—Toren, McGeady and Goldberg

[57] ABSTRACT

A tension member for use as a rock anchor or the like has a plurality of steel wires embedded in a tubular member with a central bore and formed of a hardenable plastics material, such as a synthetic resin. The outer surface of the tubular member is profiled such as in the manner of a screw thread so that an anchor member can be threaded on to the tubular member. The steel wires are arranged symmetrically around the axis of the tubular member for carrying the load transmitted by the tension member. If there is a displacement of the rock anchored by the tension member then both the tension and shearing stresses acting on the wires can cause individual wires to be displaced from the tubular member into its central bore. As a result, the flexibility of the tension member is increased and the most highly stressed wires can move out of the tubular member into its central bore.

11 Claims, 8 Drawing Figures

FIG. 1
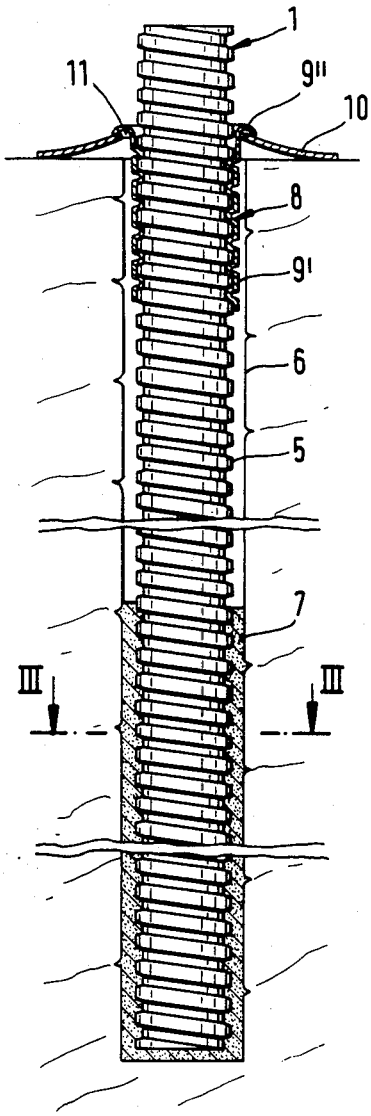
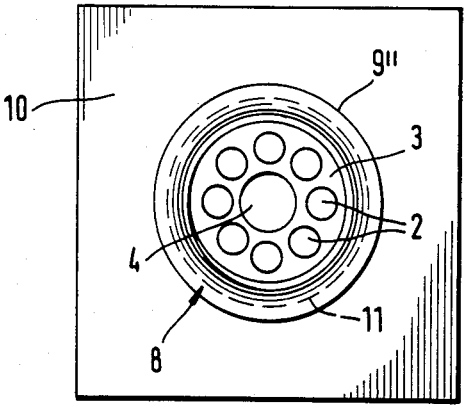
FIG. 2
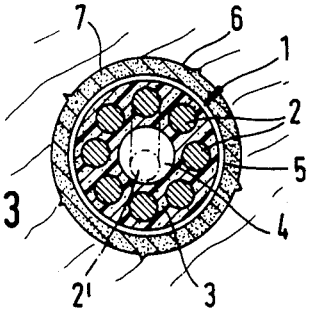
FIG. 3
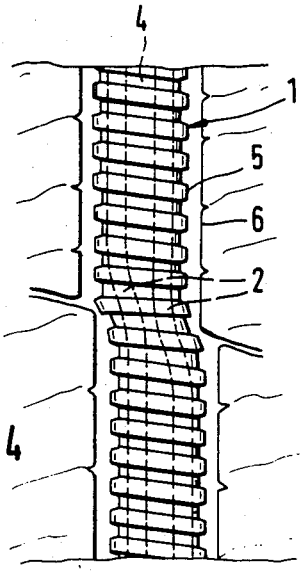
FIG. 4

TENSION MEMBER FOR A ROCK ANCHOR OR THE LIKE

BACKGROUND OF THE INVENTION

The present invention is directed to a tension member for use as a rock anchor or the like and also to a method for forming the tension member Rock anchors are used to secure a mass of rock against shifting at the earliest possible time when driving tunnels or similar cavities into natural stratified rock formations with open seams or crevices. Typically, such rock anchors are subjected to a combination of tension and shearing stresses when one part of the rock mass moves relative to another. Tension members used as rock anchors must be able to deform under the considerable deforming forces developed. The stiffness of a solid cross-section of the tension member, such as in a steel rod, can be an obstacle to the absorption of the deforming forces.

Tubular shaped tension members formed of steel with thin walls have been known which have been pressed by hydraulic pressure against a borehole wall for transmitting forces through friction. Such tubular shaped tension members have an even lower resistance to shear than rod-shaped tension members or anchors, however, they do afford greater shear travel since the borehole containing the tension member remains essentially free. Tubular shaped tension members have no corrosion protection and can not be fabricated in random lenghts. Anchor members can not be secured to the smooth outer surfaces of such members.

SUMMARY OF THE INVENTION

Therefore, it is the primary object of the present invention to provide a tension member for use as a rock anchor which can be economically produced in random lengths, and has a high degree of deformability for withstanding the deflecting forces developed in a rock mass when part of the mass move relative to another part. Moreover, another feature of the invention is to provide a tension member to which an anchoring member can be secured where the anchoring member is in the form of a threaded nut or the like.

In accordance with the present invention, the tension member is formed by a plurality of steel wires embedded in a tubular member formed of a hardenable plastics material, such as a synthetic resin, with the member forming a central bore. Further, the outside surface of the tubular member is profiled.

By dividing the steel cross-section of the tension member into a number of individual cross-sections with a small moment of resistance, and with the formation of the central bore through the tubular member and the embedment of the individual steel members in the wall of the tubular member, it is possible, when the tension member is subjected to high shearing stress, that individual ones of the steel members or wires can be displaced out of the tubular member wall affording a greater flexibility for the overall tension member whereby the buckling forces occurring due to combined shearing and tension stresses can be absorbed. As a result, the most highly loaded steel members or wires can free themselves from the bond with the wall of the tubular member and can be displaced into the central bore. Due to the higher flexibility of the tubular members as compared with rods of solid cross-section, the installation of such rock anchors is facilitated where tension members of considerable length must be installed from locations affording small space, as often is necessary when driving tunnels, drifts or the like.

Preferably, the steel wires are arranged symmetrically in the wall of the tubular member and it is advantageous if the tubular member has a circular cross-section. Further, it is also advantageous if the central bore through the tubular member has a circular cross-section.

The profiled outer surface of the tension member can be formed as a sheath arranged about the outside surface of the tubular member with the sheath formed of a thermoplastic synthetic resin. Preferably, the profiled outer surface is in the form of a screw thread so that an appropriate anchoring member can be secured on the tension member. Generally, it is sufficient if the anchoring member interlocks against the surface of the rock mass in a tunnel or the like, since the effectiveness of a rock anchor only requires a friction lock with the rock mass.

The central bore through the tension member permits, as long as it remains open after the installation of the tension member into the central bore, a check of possible shearing movement or the introduction of measuring probes. In addition, the central bore can be used for injecting a hardenable material into the central bore or it can be utilized as a vent depending on the manner in which the hardenable material is forced into the central bore. Accordingly, it is useful if at least for a partial axially extending section of the tension member that openings are provided from the central bore through the tubular member in the manner of valve-shaped openings.

In accordance with the present invention, the profiled outer surface of the tension member can be provided along partial axially extending sections of its length with the regions between the profiled sections having a smooth outer surface.

If the profiled sections of the tension member are only as long as is required for anchoring of the forces which occur, and a smooth region is provided between the profiled regions, then in the smooth regions there is no interlocking or bonding action between the tension member and any hardenable material introduced into the remaining portion of the central bore, so that the smooth outside surface regions permit bending of the tension member when shearing forces occur. This feature is particularly useful for rock anchors which hold smaller layers or strata of rock due to the anchored surfaces of the tension member separated from one another by the regions free of any bonding.

Finally, a tension member embodying the present invention affords excellent corrosion protection, since the steel wires or members are completely embedded within the plastics material, particularly if the tension member includes an outer sheath. Tension members of this type can be used as permanent anchors and afford a method for supporting the roof of an underground chamber or tunnel.

The present invention is also directed to a method of producing such a tension member. Initially, in a continuous manner, an axially extending inner tube section is formed of a plastics material, such as polyethylene, with the inner section forming the central bore. Before the material of the inner tube sections hardens, the steel wires are pressed into its outer surface. Subsequently, the steel wires and the inner tube section are enclosed by a hardenable plastics material, such as a polyester resin. To complete the operation or as part of a subsequent operation, a jacket is applied around the outside of the outer tube section and the jacket is formed of a thermoplastics material, such as polyvinylchloride.

A particular advantage of this method is that a tension member for use as a rock anchor can be produced in a continuous process and can be cut to any random length. If the profiled outer surface of the tension member is in the form of a screw thread, then an anchoring member can be secured to the tension member at any random location.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is an axially extending view, partly in section, of the tension member embodying the present invention and used as a rock anchor;

FIG. 2 is a view taken along the line II—II of the outer end of the rock anchor;

FIG. 3 is a cross-sectional view of the tension member taken along the line III—III in FIG. 1;

FIG. 4 is a partial axially extending view of the rock anchor as illustrated in FIG. 1 after bending of the anchor has occurred due to a combination of bending and shearing forces;

DETAILED DESCRIPTION OF THE INVENTION

Figure 8:
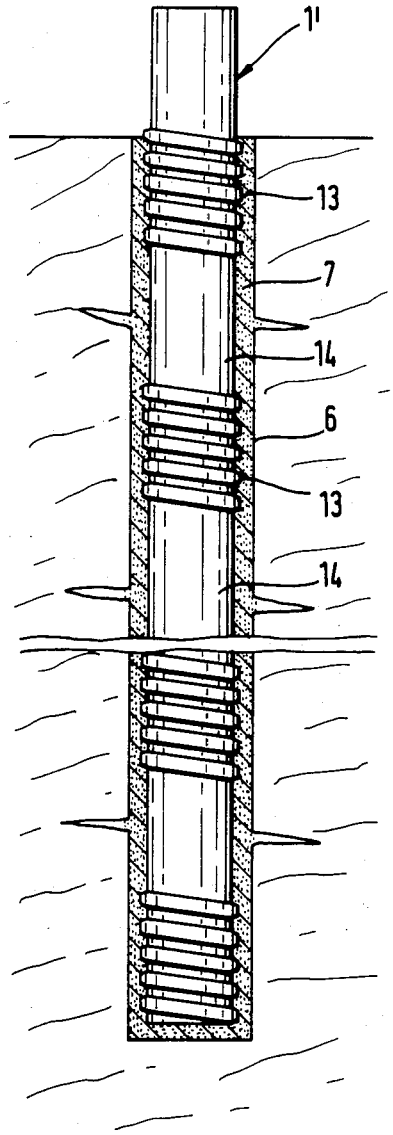
FIG. 8 is an axially extending section through an anchor member displaying another embodiment of the tension member.

In FIG. 1 an axially extending view of an anchor bolt is shown, partly in section with FIG. 2 providing an end view and FIG. 3 a cross-sectional view. An axially extending tension member 1 includes eight axially extending steel wires 2 embedded within the wall of a tubular member 3. The tubular member is formed of a hardenable plastics material, such as a synthetic resin, and preferably a polyester resin. The tubular member 3 defines a central bore 4 and the outer surface of the tubular member is a profiled surface 5 in the shape of a coarse thread. The profiled surface 5 is suitable for screwing on an anchoring member 8, such as a nut.

The tension member 1 is inserted into a borehole in a rock formation and it can be inclined in any direction with respect to a tunnel or underground space and the tension member is secured at the base or inner end of the borehole by a hardenable material 7, such as a synthetic resin or grout formed of cement mortar. The hardenable material, as is usual in so-called synthetic resin bonded anchors, can be introduced into the borehole 6 in the form of a cartridge made up of two bonding material components and the cartridge is destroyed during the insertion of the tension member causing the bonding components to be activated. It is also possible to inject the hardenable material through the central bore 4 or directly into an external annular space about the tension member. In the second possibility, the central bore 4 can act as a vent line.

The tension member 1 is secured at the mouth of the borehole 6 by the anchoring member 8. The anchoring member 8 has a threaded portion 9' screwed onto the outside profiled surface 5 of the tension member with the outer end of the threaded portion being supported against an abutment plate 10 having a central opening 11 with the bent-over outer end 9'' of the threaded portion 9' in engagement with the abutment plate around the central opening. The abutment plate around its outer edges bears against the rock into which the borehole 6 is formed and the interior of the abutment plate encircling the opening 11 is deformed outwardly affording a friction lock in the manner of a flexible clamp or interlock with the bent-over edge 9'' of the threaded portion 9'. The arrangement of the threaded portion 9' of the anchoring member 8 extending into the borehole 6, which must have a greater length because of the lower strength of the tubular member 3 compared with steel, does not extend outwardly beyond the surface of the rock mass.

In FIG. 4 the manner in which the tension member can deform under the action of local shearing forces is displayed due to the relative displacement of the rock layers or strata into which the tension member is inserted. It is assumed that this deformation occurs in the region of the rock anchor where the tension member is not bonded or interlocked with the rock strata or soil. As indicated in FIG. 4, it is assumed that one of the steel wires 2 has been displaced from the wall of the tubular member 3 into the central bore 4, as indicated by dashed lines for the wire 2' displayed in the cross section of FIG. 3.

In accordance with the present invention the tension member can have a length of 4–6 m and possibly up to 8 m. The outside diameter of the tension member is approximately 25 mm with the steel wires each having a diameter of 6 mm, and with a central bore 4 having a diameter of 9 mm. The tension member can be produced, for instance, by extrusion with the wires 2 being supplied to the extrusion head from the side so that they can be completely enclosed within the tubular member.

Figure 5:
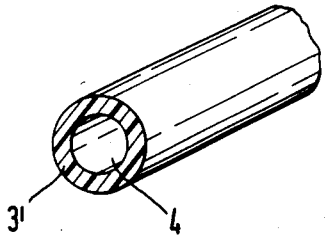
FIGS. 5–7 illustrate successive steps in the production of the tension member.
Figure 6:
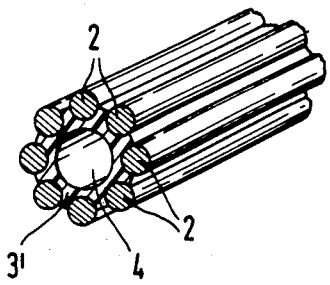
Figure 7:
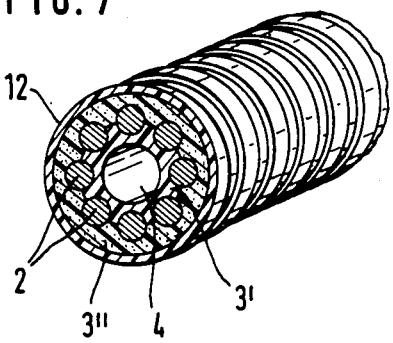

The individual steps of a particularly advantageous method of producing a tension member, embodying the present invention, is illustrated in FIGS. 5–7. Initially, an inner axially extending tube section 3' is formed in a continuous extrusion operation. The inner tube section 3' is formed of a thermoplastics material, such as polyvinylchloride. The inner tube section defines the central bore 4, note FIG. 5. Before the material forming the inside tube section 3' hardens completely, the wires 2 are pressed in the radial direction from the outside into the surface of the inner tube section, note FIG. 6. The wires are arranged in a symmetrical pattern about the inner tube section 3'.

In a subsequent method step, the wires are enclosed by another hardenable mass or axially extending outer tube section 3'' formed of a synthetic resin such as a polyester resin or the like. To complete the tension member, an outer jacket or sheath 12, formed of a thermoplastics material, such as polyvinylchloride, can be extruded onto the outer surface of the outer tube section 3''.

In this embodiment the outer jacket is formed with a coarse thread so that an anchoring nut can be screwed on to the tension member.

In FIG. 8 another embodiment of the invention is displayed. A tension member 1', serves as a rock anchor similar to that in FIG. 1, however, it does not have a profiled surface or thread along the full axial length of its outer surface, instead only partial axially extending regions 13 are provided with the thread and these threaded regions are spaced apart by smooth surface regions 14. With the tension member 1', the threaded regions provide a bonding action with the hardenable material 7 filled into the borehole 6 along its full axial length The smooth surface regions 14 do not become bonded with the hardenable material 7, accordingly, the tension member 1' can be stretched in the regions 14 between the threaded regions 13. The tubular member 3 incorporating the wires 2 can also be equipped with radially extending openings in the space between the steel wires. These openings can also be located in partial axially extending regions along the length of the tension member and serve as injection and/or ventilation openings. The injection of the annular space remaining around the tension member after it is inserted into a borehole, with a hardenable substance, such as grout or cement mortar, can be effected through the central bore 4 and then through the openings. To open up the central bore the injected material remaining in it can be flushed out.

The opening can also be arranged as valve-shaped openings so that they serve as ventilation openings when the annular space is injected with a hardenable substance by means of a special injection line located in the annular space. In other words, the valve openings only permit the escape of trapped air from the outer annular space into the central bore 4 but do not permit flow of the injected substance or possibly the water separated from the injected substance.

While specific embodiments of the invention have been shown and described in detail to illustrate the application of the inventive principles, it will be understood that the invention may be embodied otherwise without departing from such principles.

I claim:

1. Tension member for use as a rock anchor or the like, comprising an axially elongated tubular member having an inside surface forming an open central bore and an outside surface, said tubular member is formed of at least one hardenable plastics material, a plurality of axially and rectilinearly extending steel wires embedded in said tubular member between the inside and outside surfaces thereof and spaced outwardly from said bore and disposed in generally parallel relation with the axis of the central bore and the outside surface of said tubular member being profiled with alternating projections and recesses formed on the outside surface and extending in the circumferential direction thereof.

2. Tension member, as set forth in claim 1, wherein said steel wires are arranged symmetrically around the axis of said tubular member.

3. Tension member, as set forth in claim 1 or 2, wherein said tubular member has a circularly shaped outside cross-section.

4. Tension member, as set forth in claim 1 or 2, wherein the central bore has a circular cross-section.

5. Tension member, as set forth in claim 1 or 2, wherein the outside surface of said tubular member is profiled in the manner of a screw thread with alternating lands and grooves forming said projections and recesses.

6. Tension member, as set forth in claim 5, wherein the axially extending outside surface of said tubular member is profiled for partial axially extending regions thereof with smooth surface partial regions located between the profiled regions and said partial axially extending regions extending completely around the outside surface in the circumferential direction of said tubular member.

7. Tension member, as set forth in claim 1 or 2, wherein said tubular member includes a jacket forming a sheath for laterally enclosing the outside surface of the tubular member.

8. Tension member, as set forth in claim 7, wherein said jacket is formed of a thermoplastics material.

9. Tension member, as set forth in claim 8, wherein said jacket is formed of polyvinylchloride.

10. Tension member, as set forth in claim 1 or 2, wherein openings are arranged through said tubular member extending from the inside surface to the outside surface thereof with said openings being located at least in partial axially extending regions of said tubular member.

11. Tension member, as set forth in claim 10, wherein said openings are valve-like openings.

* * * * *